United States Patent [19]

Bruce

[11] 4,397,256

[45] Aug. 9, 1983

[54] ANCHORS

[76] Inventor: Peter Bruce, 12 Hollydene Ave., Onchan, Douglas, Isle of Man

[21] Appl. No.: 408,165

[22] Filed: Aug. 16, 1982

Related U.S. Application Data

[63] Continuation of Ser. No. 155,201, May 30, 1980, abandoned.

[30] Foreign Application Priority Data

Jun. 1, 1979 [GB] United Kingdom ..... 7919169

[51] Int. Cl.[3] ..... B63B 21/32

[52] U.S. Cl. ..... 114/303; 114/301

[58] Field of Search ..... 114/294–311

[56] References Cited

U.S. PATENT DOCUMENTS

| | | | |
|---|---|---|---|
| 1,497,693 | 6/1924 | Myers | 114/310 |
| 3,022,761 | 2/1962 | de Beixedon | 114/306 |
| 3,822,666 | 7/1974 | Blumberg | 114/303 |
| 3,961,451 | 6/1976 | McCain | 114/301 |

FOREIGN PATENT DOCUMENTS

| | | | |
|---|---|---|---|
| 1466433 | 1/1967 | France | 114/310 |
| 2082722 | 12/1971 | France . | |
| 2343642 | 7/1977 | France | 114/304 |
| 694976 | 7/1953 | United Kingdom . | |
| 1296139 | 11/1972 | United Kingdom | 114/301 |
| 1356259 | 6/1974 | United Kingdom | 114/301 |

*Primary Examiner*—Trygve M. Blix
*Assistant Examiner*—Stephen P. Avila
*Attorney, Agent, or Firm*—Mason, Fenwick & Lawrence

[57] ABSTRACT

A shank is provided for an anchor, which is in the form of a longitudinally extending double-plate girder with a transverse element joining the double plates. In accordance with the present invention, the transverse element is substantially spaced from the cable attachment end of the shank and is orientated with a positive attack angle so that the element can contribute to the burial force developed by the anchor. The above double-plate girder shank on the one hand provides increased resistance to bending moments in vertical and sideways directions and on the other hand enables satisfactory soil penetration by the shank due to the open construction. A plurality of the above transverse elements are preferably provided and form with the double plates passages diverging aft. The double-plate shank can be removably attached to the fluke.

14 Claims, 5 Drawing Figures

ANCHORS

This is a continuation, of application Ser. No. 155,201, filed May 30, 1980, abandoned.

This invention relates to anchors and, in particular, to shanks thereof.

The shank of an anchor is a member connecting the cable attachment point of an anchor with its fluke. This member has the function of maintaining the fluke at an inclination to the surface of a mooring bed on which the anchor is cast such that penetration therethrough and burial into the bed is achieved when a substantially horizontal pull on the anchor is applied by the cable. The shank is required to resist bending moment applied to it in a vertical plane by partial or complete penetration of the fluke in the mooring bed soil or by point loading of the fluke when engaging on rocks. It is also required to resist bending moment applied in a horizontal plane by veering of the anchor cable following engagement of the anchor fluke with the mooring bed. Provision of adequate bending moment resistance in the shank generally calls for deep sections in two transverse directions at right angles to each other and, consequently, a heavy shank which may well comprise two thirds of the total weight of the anchor and contribute considerably to the resistance of the anchor to penetration of the mooring bed without contributing to the burial forces developed by the anchor fuke. Anchors with shanks of this type are shown in U.K. patent specification Nos. 694,976, 1,296,139, 1,356,259 and 1,496,510. In a previous modified shank form, the shank comprised a pair of spaced plates with the forward ends arranged to receive a shackle bolt for the anchor line, but this structure alone did not provide adequate resistance to lateral bending. To overcome this problem a lateral web plate may be located between the spaced shank plates in the manner of an H beam but this greatly increases the resistance to soil penetration of the anchor.

An object of the present invention is to provide an anchor shank having high bending moment resistance, low soil penetration resistance, and a capability of contributing to the burial forces developed by the anchor while interacting with the mooring bed soil.

According to the present invention there is provided an anchor including a fluke and a shank adapted at one end to be attached to an anchor line and at the other end to the fluke the shank comprising at least two transversely spaced longitudinal plate members connected by at least one transverse plate member located between said shank ends and having a portion inclined to present a positive angle of attack to the sea bed soil, at least one rearwardly-directed passage being defined by one of (a) the longitudinal plate members and successive transverse inclined plate members and (b) the longitudinal plate members and a transverse inclined plate member and the fluke; said rearwardly directed passage being substantially non-convergent rearwardly with the cross-sectional area of its outlet being not substantially less than the cross-sectional area of its inlet to permit high-pressure shear-expanded soil over the fluke to escape freely and substantially without obstruction through the shank.

By arranging the transverse plate member to be inclined in the above described manner, any substantial increase of resistance to soil penetration by the shank can be avoided, while allowing high bending moment resistance to be present in the shank, and additionally allowing the plate member arrangement to contribute to the burial forces generated by the anchor by acting as an auxiliary fluke.

Preferably said plate member occupies a substantially mid location between the shank ends.

Preferably, the transverse plate is inclined at an acute angle to the fluke in the range 0° to 40°, and preferably 5° to 25°.

Preferably a plurality of transverse plate members are provided. Preferably the cross-sectional area bounded by the longitudinal members and successive transverse plate members increases rearwardly to provide divergent passages to soil flowing between the longitudinal members. Preferably the inclination of each plate member to the fluke centre line increases with remoteness from the fluke to provide said divergent passages.

Preferably the shank is of L-shaped form, and a transverse plate member is located in the shorter fluke attached leg of the shank; and preferably said plate member is located adjacent the elbow of the L-shaped shank.

The longitudinal shank members can be arranged to extend in parallel, but preferably forward portions of the members converge and form a lug for receiving the anchor cable shackle bolt. In a preferred arrangement the converging portions make backwardly inclined line intercepts with the parallel longitudinal members whereby the converging portions define burial surfaces. The shank can be detachably secured to the fluke.

The above shank according to the present invention can be applied to a wide variety of fluke forms. In particular, it is very satisfactorily used in an anchor according to the applicants U.K. Pat. Nos. 1356259 and 1513453. The present shank permits a considerable reduction in weight of the shank, so that for a given anchor size, the fluke weight (and size) can be very considerably increased which will give a substantial increase in holding power.

Embodiments of the invention will now be described, by way of example, with reference to the accompanying drawings in which.

Figure 1:
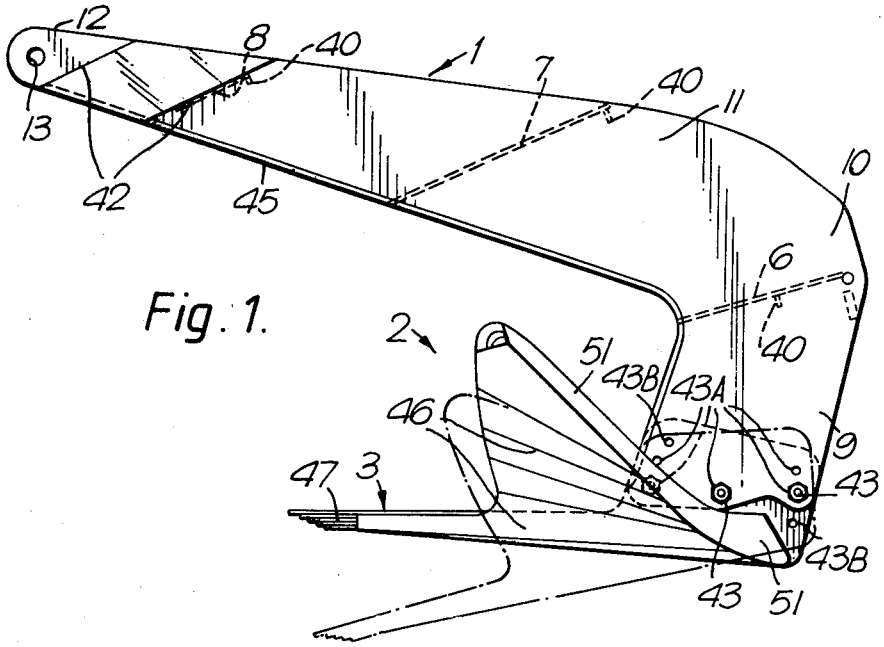
FIG. 1 is a side elevation of an anchor with a shank according to one embodiment of the present invention.
Figure 2:
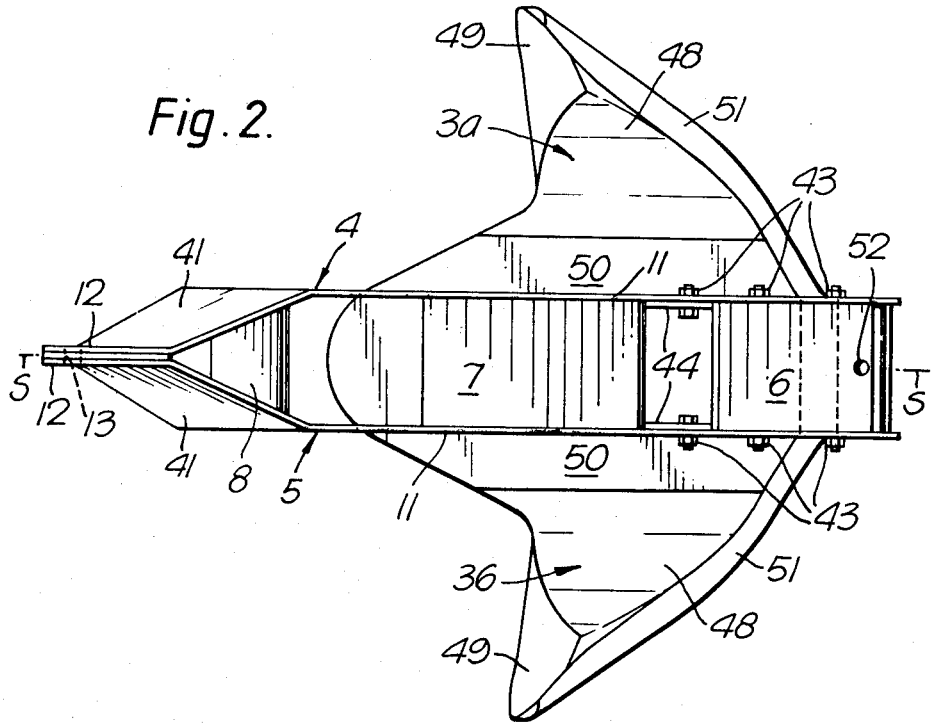
FIG. 2 is a plan view of the anchor of FIG. 1.
Figure 3:
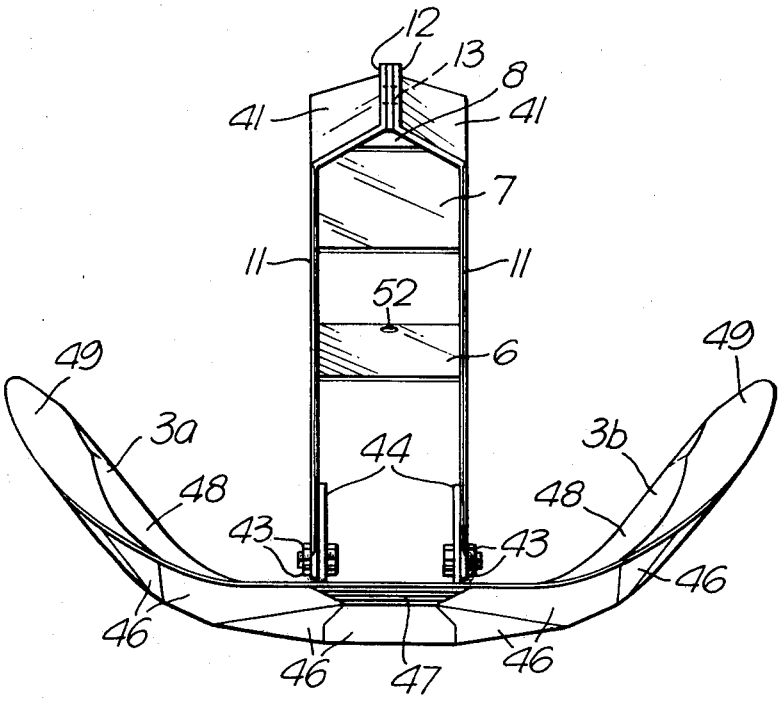
FIG. 3 is a front elevational view of the anchor of FIG. 1.

Referring to FIGS. 1, 2 and 3 an anchor shank 1 of an anchor 2 is attached to a fluke 3 and comprises two L-shaped plates 4,5 generally equally spaced one at each side of a central plane of symmetry S—S of the anchor 2 and connected together by inclined plates 6,7,8 each having approximately half of the thickness of the L-shaped plates 4,5. Each L-shaped plate 4,5 has a first leg 9 adapted to be joined at its lower end to fluke 3 and extending from the fluke surface adjacent a central symmetry plane to an elbow 10 spaced from and above the fluke surface. The L-shaped plates 4,5 are spaced apart approximately twelve times their thickness and have maximum depth of section at the elbow 10 of approximately twenty-two times their thickness. A second leg 11 extends at an angle to its bottom edge of 20° relative to a line intercept of the fluke upper surface with the symmetry plane and forwardly from the elbow 10 to a free end or lug 12 bored with a hole 13 to provide aligned bores suitable for receiving one end of a bolt (not shown) to a shackle for attachment of a chain, cable or rope to the ends 12 of the shank.

The inclined plate 6 is located below the elbow 10 with its forward edge spaced approximately 39 times its thickness from the fluke in a direction normal to plate 6, being inclined at an angle of 10° i.e. with positive burial angle to the line intercept of the fluke upper surface with the symmetry plane of the anchor while extending substantially fully between forward and rear edges of each first leg 9 of plates 4,5.

The inclined plate 7 is located above and forward of plate 6 and is spaced from the front edge of plate 6 approximately 42 times its thickness in a direction normal to plate 6, being inclined at 14° to the line intercept of the fluke upper surface with the symmetry plane while extending fully between lower and upper edges of each second leg 11 of plates 4, 5.

The inclined plate 8 is located forward of plate 7 and is spaced approximately 30 times its thickness from the forward edge of plate 7 in a direction normal to plate 7, being inclined at 18° to the line intercept of the fluke upper surface with the symmetry plane of the anchor. The plates 6,7,8 can include stiffener ribs 40.

The legs 11 include forward flat converging portions 41 which are bent to provide parallel front lug portions 12, and the portions 41 are shaped to provide burial surfaces, the portions 41 providing backwardly inclined line intercepts 42 with the legs 11 and the symmetry plane S—S. As can be seen in FIG. 1, these intercepts 42 are inclined similarly as the plate 8. The shank 1 is removably secured to the fluke 3 by legs 9 being removably attached by bolts 43 to upstanding flanges 44 on the fluke 3. By virtue of holes 43A in both legs 9 and flanges 44 and holes 43B in flanges 44 only, bolts 43 can be repositioned to permit the fluke angle to be increased for soft bottoms as indicated in FIG. 1. The detachability of the shank facilitates the storage and transportability of the anchor, particularly for large size anchors, the plates 4,5 include leading edges 45 of knife-edge form.

The geometry of the fluke 3 including side portions **3*a*, 3*b* satisfies the applicant's U.K. Pat. Nos. 1356259 and 1513453, and as best seen in FIG. 3 the central fluke portion 3 is substantially flat with the sides 3*a*, 3*b*, of curved form. The anchor which for example can be of 250 Kg weight or greater, is conveniently made of a steel fabrication construction. In particular, the fluke 3 is of hollow double skin form. The bottom skin comprises plate segment 46 with a nose portion 47 of stacked plate form, while the upper skin comprises side plate segments 48, 49 and flat central plate 50. The hollow fluke formation is closed by back plates 51. The flanges 44 extend through slots (not shown) in top plate 50 and rest on the bottom skin to which they are welded. Additionally internal ribs could be provided in the hollow fluke structure. The various plate segments are joined by welding. The plates of portions 3*a*, 3*b* can be placed in curved form by a series of straight line bends, and these portions provide conical working surface with a cone apex located rearwardly. More particularly, the surfaces of part segments 48, 49 an have different semi-cone angles; and with reference to FIG. 3, the segment 48 can have a semi-cone angle of approximately 25° while the outer segment 49** is of more splayed form with a semi-cone angle of approximately 42°. This feature facilitates the rolling self-orientating and dynamic stabilising characteristics of the anchor as explained in U.K. Pat. No. 1356259.

The hollow portions of the fluke can be filled with suitable material e.g. concrete or resin to strengthen the structure and also to vary the weight of the anchor as desired. In the present shank, the webs 6–8 take the majority of the shear load enabling the plate members 4,5 to be of relatively thin form; for example in a 6½ ton single-member shank anchor, the shank plate would have a width of 8 ins. while with the present double-plate shank the plates 4,5 could be each 2 in. thick. Consequently, the shank can be considerably lighter than previously and more weight can be transferred to the fluke which is advantageous performance wise. In the anchor of FIGS. 1 to 3, the central portion 3 is of substantially greater size than previously due to the added area enclosed between the planes of plates 4.5.

Figure 4:
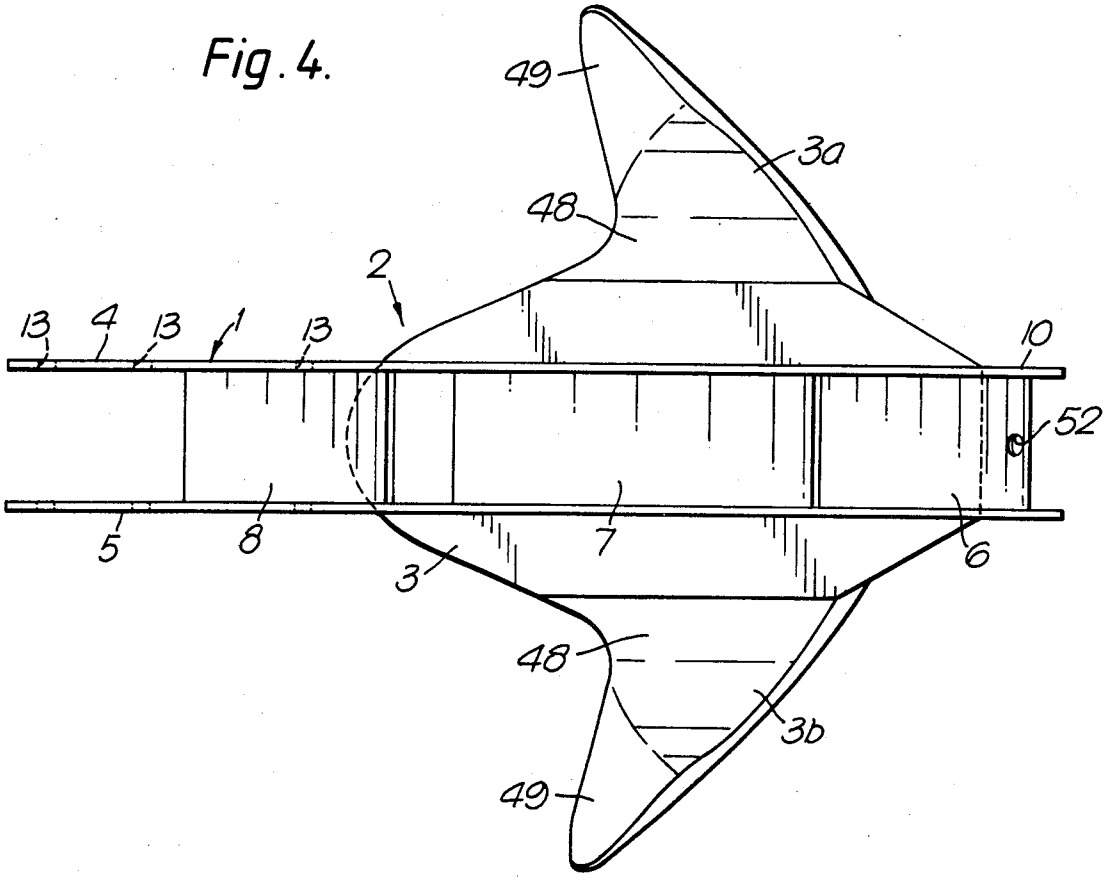
FIG. 4 shows a plan view of an anchor with a shank, according to a second embodiment of the present invention.

In the embodiment shown in FIG. 4, the plates 4,5 are arranged to be completely parallel. The spaced-parallel plate form of the shank facilitates the provision of a plurality of aligned hole pairs in the forward part of the shank, for reception of the anchor line shackle bolt, so enabling variation in the position of the bolt. Variation in shackle bolt position alters the attack angle of the fluke; for example a more rearward position provides a greater fluke attack angle and this is more satisfactory for use in a mud bed. Also, the plate 6 can have a hole 52 facilitating the fitteing of an anchor break-out line to the anchor. The above anchors will have a very high per unit weight holding power and will also incorporate the stabilising characteristics of the anchors of U.K. Pat. No. 1356259: the anchors can therefore be satisfactorily used for mooring vessels or installations in severe offshore conditions.

Figure 5:
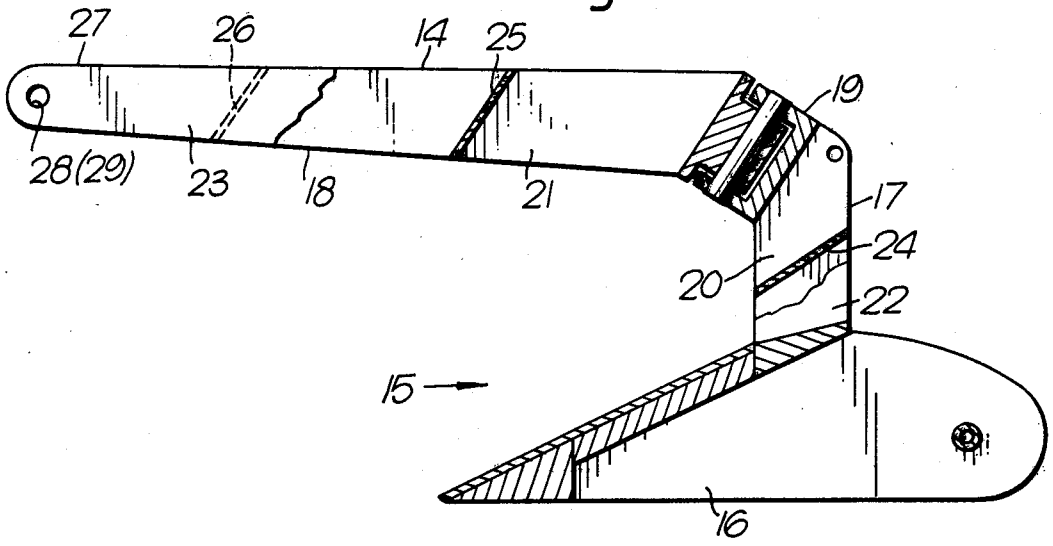
FIG. 5 shows in partially sectional side elevation the shank of the present invention applied in an anchor with a different fluke form.

Referring now to FIG. 5, an L-shaped articulated anchor shank 14 of an anchor 15 is attached to a fluke 16 and comprises a downwardly extending first leg 17 and a forwardly extending second leg 18 joined together pivotably by a pin-jointed elbow 19 spaced from and above the fluke surface. Each leg 17 and 18 comprises elongate plates 20, 21 and 22, 23 respectively spaced one at each side of a symmetry plane of the anchor and connected by inclined plates 24, 25, 26 extending over the full depth of the elongate plates and inclined respectively at 7°, 29°, and 30° to the line intercept of the fluke upper surface with the symmetry plane and with plate 24 located midway on leg 17 and plates 25,26 to trisect leg 18.

The second leg 18 extends at an angle to its bottom edge of 28° relative to a line intercept of the fluke upper surface with the symmetry plane and forwardly from the articulated elbow 19 to a free end 27 bored with coaxial holes 28, 29 suitable for receiving the ends of a bolt of a shackle for attachment of a chain, cable or rope to the end 27 of the shank.

In the above embodiments each passageway through the shank between plates 7/8 (25/26) and 6/7 and 6/30 diverges rearwards.

The open construction of the shank permits soil to pass easily through the structure and so gives low penetration resistance during burial of the anchor. The divergent passages within the shank accommodate those soils which expand during shearing so that the tendency of the expanded soil to jam within the passages is avoided thus maintaining a low resistance to penetration of the shank even in dense sands. Soil impinging on the inclined plates inside the shank develops a thrust with a downwards component which adds to that produced by the anchor fluke and so assists burial of the anchor.

Modifications are of course possible. For example where the plates 4,5 converge: the convergent plates themselves would promote the divergent passage between successive inclined transverse plates 6,7,8 so that the plates 6,7,8 could be positioned parallel to each other. The plates 6, 7 8 may form part of transverse hollow elements.

I claim:

1. An anchor including a fluke and a shank of cranked form having a longer leg adapted at one end to be attached to an anchor line and a shorter leg adapted at one end to be attached to a fluke, the shank comprising at least two transversely spaced elongate plate members including leading and trailing edges and connected by at least one transverse plate member located between said shank ends and having at least a portion included to present a positive angle of attack to the sea bed soil, a plurality of open-ended passages being provided between the elongate plate members and serving to permit substantially unobstructed foil flow through the shank, one of said open-ended passages being located adjacent the fluke and in the shorter leg of the shank to permit escape of a rearward flow of soil between the parts of the trailing edges of said elongate plate members in the shorter leg.

2. An anchor according to claim 1, wherein the transverse plate member occupies a substantially mid-location between the shank ends.

3. An anchor according to claim 1 or 2, wherein the transverse plate member is inclined at an acute angle to the fluke in the range of 0 degrees to 40 degrees.

4. An anchor according to claim 3, wherein said acute angle lies in the range 5 degrees to 25 degrees.

5. An anchor according to claim 1, wherein a plurality of transverse plate members are provided, the cross-sectional area bounded by the longitudinal members and successive transverse plate members increased rearwardly to provide divergent passages to soil flowing between the elongate plate members.

6. An anchor according to claim 5, wherein the inclination of each transverse plate member to the fluke center line increases with remoteness from the fluke to provide said divergent passages.

7. An anchor according to claim 1, wherein a transverse plate member is located in the shorter leg of the shank.

8. An anchor according to claim 7, wherein the transverse plate member is located adjacent the elbow of the L-shaped shank.

9. An anchor according to claim 1, wherein the spaced elongate plate members are parallel, and forward aligned holes are provided in the members to receive a shackle bolt.

10. An anchor according to claim 9, wherein a plurality of longitudinally arranged aligned hole pairs are provided in the shank longitudinal members for different shackle settings.

11. An anchor according to claim 1, wherein at least a portion of the transversely spaced elongate members converge towards the anchor line attachment end of the shank.

12. An anchor according to claim 11, wherein at least a portion of the transversely spaced elongate members converges obliquely towards the anchor line attachment end of the shank to provide exterior burial surfaces on the shank inclined to present a positive angle of attack to the sea bed soil.

13. An anchor according to claim 1, including bolted attachment means securing the fluke to the shank and having a plurality of bolt holes positioned to allow bolt attachment of the anchor fluke in a plurality of angular positions relative to the shank for variation of the fluke angle of attack.

14. An anchor including a fluke and a shank of cranked form having a longer leg adapted at one end to be attached to an anchor line and a shorter leg at the other end adapted to be connected to the fluke, the shank comprising at least two transversely spaced elongate plate members connected by transverse plate members located between said shank ends, the shank having leading and trailing edges, at least one of said transverse plate members having a portion inclined to present a positive angle of attack to the sea bed soil, rearwardly-directed passages being devined by (a) the elongate plate members and successive transverse inclined plate members and (b) the elongate plate members and a transverse inclined plate member and the fluke; each rearwardly-directed passage being substantially non-convergent rearwardly with the cross-sectional area of its outlet being not substantially less than the cross-sectional area of its inlet to permit high-pressure shear-expanded soil over the fluke to escape freely and substantially without obstruction through the shank, the rearwardly directed passage located adjacent the fluke and in the shorter leg of the shank serving to permit escape of a rearward flow of soil between the parts of the trailing edges of said elongate plate members in the shorter leg.

* * * * *